US007927480B2

(12) United States Patent
Podrebarac

(10) Patent No.: US 7,927,480 B2
(45) Date of Patent: Apr. 19, 2011

(54) PROCESS FOR DESULFURIZATION OF CRACKED NAPHTHA

(75) Inventor: Gary G. Podrebarac, Houston, TX (US)

(73) Assignee: Catalytic Distillation Technologies, Pasadena, TX (US)

( * ) Notice: Subject to any disclaimer, the term of this patent is extended or adjusted under 35 U.S.C. 154(b) by 411 days.

(21) Appl. No.: 12/021,851

(22) Filed: Jan. 29, 2008

(65) Prior Publication Data

US 2009/0188837 A1 Jul. 30, 2009

(51) Int. Cl.
*C10G 45/00* (2006.01)

(52) U.S. Cl. ..... 208/210; 208/177; 208/208 R; 208/209; 208/211; 208/212; 208/213; 208/218; 208/145; 208/142; 585/250; 585/259; 585/260; 585/264; 585/265; 585/275; 585/276

(58) Field of Classification Search ..... 208/210
See application file for complete search history.

(56) References Cited

U.S. PATENT DOCUMENTS

| | | | | |
|---|---|---|---|---|
| 2,793,170 | A | 5/1957 | Stiles et al. | |
| 4,731,229 | A | 3/1988 | Sperandio | |
| 5,073,236 | A | 12/1991 | Gelbein et al. | |
| 5,266,546 | A | 11/1993 | Hearn | |
| 5,320,742 | A | 6/1994 | Fletcher et al. | |
| 5,431,890 | A | 7/1995 | Crossland et al. | |
| 5,597,476 | A | 1/1997 | Hearn et al. | |
| 5,730,843 | A | 3/1998 | Groten et al. | |
| 5,779,883 | A | 7/1998 | Hearn et al. | |
| 6,083,378 | A * | 7/2000 | Gildert et al. | 208/209 |
| 6,303,020 | B1 | 10/2001 | Podrebarac et al. | |
| 6,416,658 | B1 | 7/2002 | Maraschino et al. | |
| 6,444,118 | B1 | 9/2002 | Podrebarac et al. | |
| 6,495,030 | B1 * | 12/2002 | Podrebarac | 208/218 |
| 6,678,830 | B1 | 1/2004 | Mustafa et al. | |
| 6,824,679 | B1 | 11/2004 | Dzengeleski et al. | |
| 6,881,324 | B2 | 4/2005 | Smith, Jr. | |
| 2003/0230518 | A1 * | 12/2003 | Smith, Jr. | 208/210 |

OTHER PUBLICATIONS

International Search Report issued in PCT Application No. US2009/031211, dated May 27, 2009. (3 pages).

Written Opinion of the International Searching Authority issued in PCT Application No. US2009/031211, dated May 27, 2009. (5 pages).

* cited by examiner

*Primary Examiner* — Glenn A Caldarola
*Assistant Examiner* — Michelle L Stein
(74) *Attorney, Agent, or Firm* — Osha • Liang LLP

(57) ABSTRACT

A process for the desulfurization of a fluid catalytically cracked naphtha wherein the valuable olefins are retained and recombinant mercaptans are prevented from forming, resulting in a low sulfur naphtha. Embodiments disclosed herein may allow for more flexibility in varying the end point of the naphtha used in gasoline blending.

16 Claims, 4 Drawing Sheets

PROCESS FOR DESULFURIZATION OF CRACKED NAPHTHA

BACKGROUND OF DISCLOSURE

1. Field of the Disclosure

Embodiments disclosed herein relate generally to a process for reducing the sulfur content of hydrocarbon streams. More specifically, embodiments disclosed herein relate to an improved process for the removal of sulfur compounds from a full boiling range naphtha, preferably fluid catalytically cracked naphtha. More particularly, embodiments disclosed herein relate to a process for the desulfurization of a fluid catalytically cracked naphtha wherein the valuable olefins are retained and recombinant mercaptans are prevented from forming, resulting in a low sulfur naphtha. More particularly, embodiments disclosed herein relate to a process which allows for more flexibility in varying the end point of the naphtha used in gasoline blending.

2. Background

Petroleum distillate streams contain a variety of organic chemical components.

Generally the streams are defined by their boiling ranges which determine the composition. The processing of the streams also affects the composition. For instance, products from either catalytic cracking or thermal cracking processes contain high concentrations of olefinic materials as well as saturated (alkanes) materials and polyunsaturated materials (diolefins). Additionally, these components may be any of the various isomers of the compounds.

The composition of untreated naphtha as it comes from the crude still, or straight run naphtha, is primarily influenced by the crude source. Naphthas from paraffinic crude sources have more saturated straight chain or cyclic compounds. As a general rule most of the "sweet" (low sulfur) crudes and naphthas are paraffinic. The naphthenic crudes contain more unsaturates and cyclic and polycylic compounds. The higher sulfur content crudes tend to be naphthenic. Treatment of the different straight run naphthas may be slightly different depending upon their composition due to crude source.

Reformed naphtha or reformate generally requires no further treatment except perhaps distillation or solvent extraction for valuable aromatic product removal. Reformed naphthas have essentially no sulfur contaminants due to the severity of their pretreatment for the process and the process itself.

Cracked naphtha as it comes from the catalytic cracker has a relatively high octane number as a result of the olefinic and aromatic compounds contained therein. In some cases this fraction may contribute as much as half of the gasoline in the refinery pool together with a significant portion of the octane.

Catalytically cracked naphtha (gasoline boiling range material) currently forms a significant part (≈⅓) of the gasoline product pool in the United States and it provides the largest portion of the sulfur. The sulfur impurities may require removal, usually by hydrotreating, in order to comply with product specifications or to ensure compliance with environmental regulations. Some users require the sulfur of the final product to be below 50 wppm.

The most common method of removal of the sulfur compounds is by hydrodesulfurization (HDS) in which the petroleum distillate is passed over a solid particulate catalyst comprising a hydrogenation metal supported on an alumina base. Additionally copious quantities of hydrogen are included in the feed. The hydrodesulfurization reaction results in the production of hydrogen sulfide according to the following reaction: $RSH+H_2 \leftrightarrows R'+H_2S$. Typical operating conditions for standard single pass fixed bed HDS reactors, such as in a trickle bed reactor, are temperatures ranging from 600° F. to 780° F., pressures ranging from 600 to 3000 psig, hydrogen recycle rates ranging from 1500 to 3000 scf/bbl, and fresh hydrogen makeup ranging from 700 to 1000 scf/bbl.

After the hydrotreating is complete, the product may be fractionated or simply flashed to release the hydrogen sulfide and collect the now desulfurized naphtha. In addition to supplying high octane blending components the cracked naphthas are often used as sources of olefins in other processes such as etherifications, oligomerizations, and alkylations. The conditions of hydrotreating of the naphtha fraction to remove sulfur will also saturate some of the olefinic compounds in the fraction reducing the octane and causing a loss of source olefins. The loss of olefins by incidental hydrogenation is detrimental, reducing the octane rating of the naphtha and the reduction in the pool of olefins for other uses.

Various proposals have been made for removing sulfur while retaining the more desirable olefins. Since the olefins in the cracked naphtha are mainly in the low boiling fraction of these naphthas and the sulfur containing impurities tend to be concentrated in the high boiling fraction the most common solution has been prefractionation prior to hydrotreating. The prefractionation produces a light boiling range naphtha which boils in the range of $C_5$ to about 250° F. and a heavy boiling range naphtha which boils in the range of from about 250-475° F.

The predominant light or lower boiling sulfur compounds are mercaptans while the heavier or higher boiling compounds are thiophenes and other heterocyclic compounds. The separation by fractionation alone will not remove the mercaptans. However, in the past the mercaptans have been removed by oxidative processes involving caustic washing. A combination oxidative removal of the mercaptans followed by fractionation and hydrotreating of the heavier fraction is disclosed in U.S. Pat. No. 5,320,742. In the oxidative removal of the mercaptans the mercaptans are converted to the corresponding disulfides.

Several U.S. patents describe the concurrent distillation and desulfurization of naphtha, including U.S. Pat. Nos. 5,597,476; 5,779,883; 6,083,378; 6,303,020; 6,416,658; 6,444,118; 6,495,030; 6,678,830 and 6,824,679. In each of these patents, the naphtha is split into two or three fractions based upon boiling point or boiling ranges.

U.S. Pat. No. 5,597,476 discloses a two-step process in which naphtha is fed to a first distillation column reactor which acts as a depentanizer or dehexanizer with the lighter material containing most of the olefins and mercaptans being boiled up into a first distillation reaction zone where the mercaptans are reacted with diolefins to form sulfides which are removed in the bottoms along with any higher boiling sulfur compounds. The bottoms are subjected to hydrodesulfurization in a second distillation column reactor where the sulfur compounds are converted to hydrogen sulfide and removed.

The use of two or more sequential catalyzed hydrodesulfurization treatments has been practiced for treating petroleum feeds to remove the organic sulfur compounds, however in these prior processes there is a significant quantity of "recombinant sulfur" in the product. Recombinant sulfur means organic sulfur compounds, mainly mercaptans, that are formed by the reverse reaction of hydrogen sulfide from the preceding hydrodesulfurization or hydrodesulfurizations in succeeding hydrodesulfurizations with olefins in the feed. The hydrogen sulfide can recombine to form mercaptans, as illustrated in the following reaction, thus increasing the amount of sulfur in the product.

$$H_2S+RC{=}CR' \leftrightarrow RC{-}CR'SH+R(SH)C{-}CR'.$$

Also, the presence of hydrogen sulfide can cause more of the olefins to be saturated, losing octane and consuming hydrogen. The formation of mercaptans during the hydrodesulfurization of FCC gasoline is well known to occur, as disclosed in U.S. Pat. No. 2,793,170. Recombinant mercaptans may form due to the relatively high concentration of hydrogen sulfide in the flash or overhead system (compared to the concentration of hydrogen sulfide within a reactive distillation column, for example).

Accordingly, there exists a need for processes for the hydrodesulfurization of FCC gasoline which minimize or control the formation of recombinant mercaptans.

SUMMARY OF THE DISCLOSURE

In one aspect, embodiments disclosed herein relate to a process for reducing the sulfur content of a hydrocarbon stream, the process including: feeding a pre-fractionated naphtha stream comprising organic sulfur compounds to a first catalytic distillation reactor system having one or more reaction zones comprising a hydrodesulfurization catalyst; feeding hydrogen to the first catalytic distillation reactor system; concurrently in the first catalytic distillation reactor system: fractionating the pre-fractionated naphtha stream into a heavy naphtha fraction and an intermediate naphtha fraction; contacting hydrogen and the intermediate naphtha fraction in at least one of the reaction zones to form hydrogen sulfide and an intermediate naphtha fraction of reduced organic sulfur content; contacting hydrogen and the heavy naphtha fraction in at least one of the reaction zones to form hydrogen sulfide and a heavy naphtha fraction of reduced organic sulfur content; recovering the intermediate naphtha fraction, hydrogen sulfide, and any unreacted hydrogen as a first overheads fraction; recovering the heavy naphtha fraction and dissolved hydrogen sulfide as a first bottoms fraction; stripping the hydrogen sulfide from the first overheads fraction; feeding the stripped first overheads fraction to a second catalytic distillation reactor system having one or more reaction zones comprising a hydrodesulfurization catalyst; feeding hydrogen to the second catalytic distillation reactor system; concurrently in the second catalytic distillation reactor system: fractionating the stripped first overheads fraction stream into a light intermediate naphtha fraction and a heavy intermediate naphtha fraction; contacting hydrogen and the light intermediate naphtha fraction in at least one of the reaction zones to form hydrogen sulfide and a light intermediate naphtha fraction of reduced organic sulfur content; contacting hydrogen and the heavy intermediate naphtha fraction in at least one of the reaction zones to form hydrogen sulfide and a heavy intermediate naphtha fraction of reduced organic sulfur content; recovering the light intermediate naphtha fraction, hydrogen sulfide, and any unreacted hydrogen as a second overheads fraction; recovering the heavy intermediate naphtha fraction as a second bottoms fraction; recycling at least a portion of the second bottoms fraction to the first catalytic distillation reactor system; stripping the hydrogen sulfide from the first bottoms fraction to recover a heavy naphtha fraction of reduced sulfur content; stripping the hydrogen sulfide from the second overheads fraction to recover a light intermediate naphtha fraction of reduced sulfur content.

Other aspects and advantages will be apparent from the following description and the appended claims.

DETAILED DESCRIPTION

Figure 1:
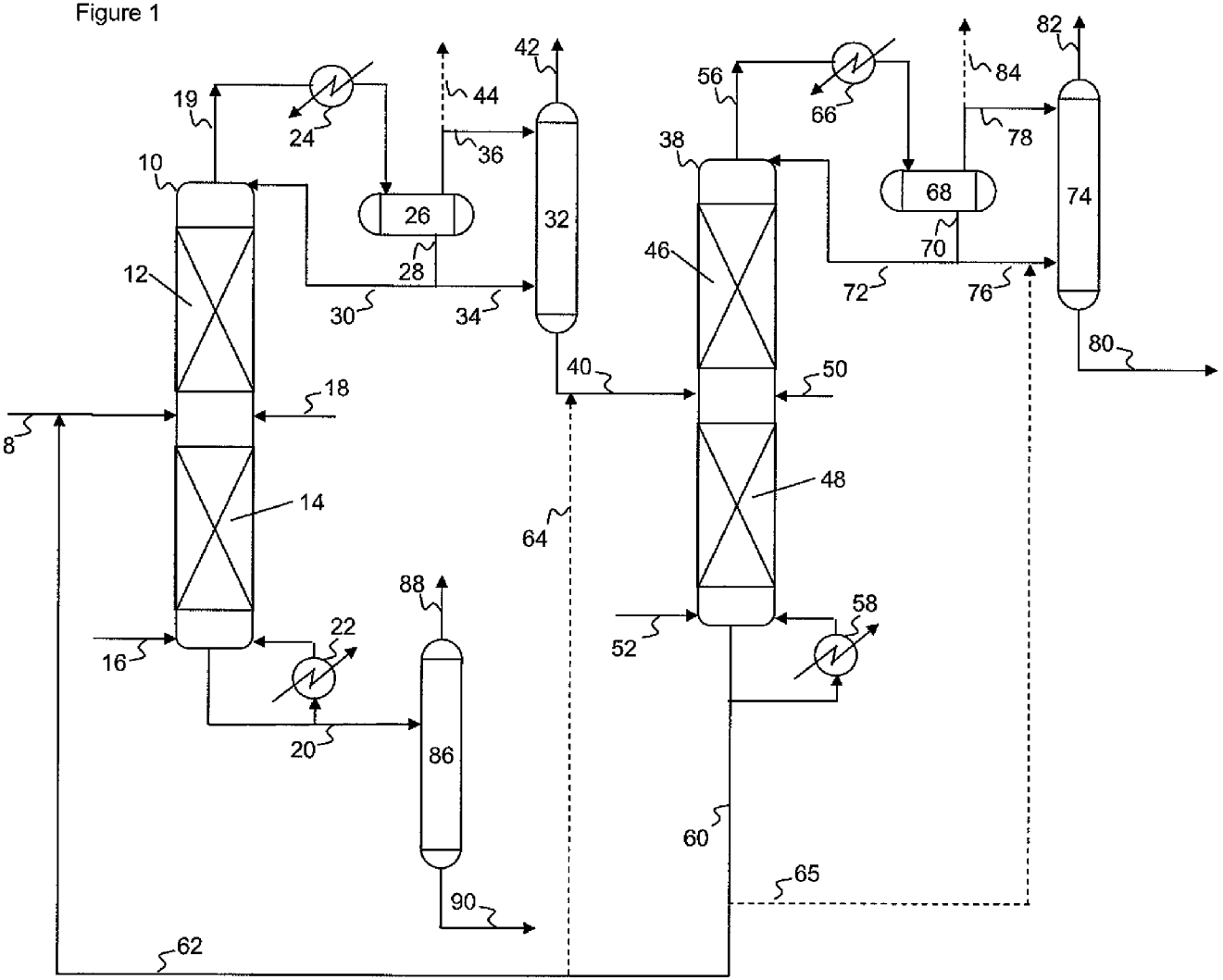
FIG. 1 is a simplified flow diagram for hydrodesulfurization processes having flexibility in varying the end point of a gasoline product according to embodiments disclosed herein.

In one aspect, embodiments disclosed herein relate to hydrodesulfurization processes. The hydrodesulfurization processes disclosed herein may provide a high degree of flexibility to vary the end point of a gasoline product. The hydrodesulfurization processes include hydrodesulfurization of a naphtha feed in one or more catalytic distillation reactor systems. Processes disclosed herein may also provide for reduced recombinant mercaptan formation.

"Recombinant mercaptans," as used herein, refers to mercaptans that are not in the feed to the present process but are the reaction products of the $H_2S$ generated by the hydrogenation of the present process and alkenes in the feed. Thus, the recombinant mercaptans are not necessarily the same as those destroyed by the hydrogenation of first portion of the present process, although they may be. The present catalytic distillation hydrogenation process is considered to dissociate substantially all of the mercaptans in the feed and the small amounts of mercaptans observed in the product streams are in fact recombinant mercaptans. Although catalytic distillation reactions are superior to the prior art straight hydrogenation for removing mercaptans, the dynamic system of a catalytic distillation allows sufficient time for some undesirable recombination reaction to occur. Thus, in embodiments disclosed herein, the combination of a high temperature, low pressure hydrodesulfurization reactor is sufficient to dissociate the recombinant mercaptans, resulting in a reduced overall sulfur content in the hydrocarbons being processed.

Within the scope of this application, the expression "catalytic distillation reactor system" denotes an apparatus in which the hydrodesulfurization reaction and the separation of the products take place at least partially simultaneously. The apparatus may comprise a conventional catalytic distillation column reactor, where the reaction and distillation are concurrently taking place at boiling point conditions, or a distillation column combined with at least one side reactor, where the side reactor may be operated as a liquid phase reactor or a boiling point reactor. While both catalytic distillation reactor systems described may be preferred over conventional liquid phase reaction followed by separations, a catalytic distillation column reactor may have the advantages of decreased piece count, reduced capital cost, increased catalyst productivity per pound of catalyst, efficient heat removal (heat of reaction may be absorbed into the heat of vaporization of the mixture), and a potential for shifting equilibrium. Divided wall distillation columns, where at least one section of the divided wall column contains a catalytic distillation structure, may also be used, and are considered "catalytic distillation reactor systems" herein.

The feed to the processes disclosed herein may be a sulfur-containing petroleum fraction which boils in the gasoline boiling range, including FCC gasoline, coker pentane/hexane, coker naphtha, FCC naphtha, straight run gasoline, and mixtures containing two or more of these streams. Such gasoline blending streams typically have a normal boiling point within the range of 0° C. and 260° C., as determined by an ASTM D86 distillation. Feeds of this type include light naphthas typically having a boiling range of about $C_6$ to 165° C. (330° F.); full range naphthas, typically having a boiling range of about $C_5$ to 215° C. (420° F.), heavier naphtha fractions boiling in the range of about 125° C. to 210° C. (260° F. to 412° F.), or heavy gasoline fractions boiling in the range of about 165° C. to 260° C. (330° F. to 500° F.). In general, a gasoline fuel will distill over the range of from about room temperature to 260° C. (500° F.).

Organic sulfur compounds present in these gasoline fractions occur principally as mercaptans, aromatic heterocyclic compounds, and disulfides. Relative amounts of each depend on a number of factors, many of which are refinery, process and feed specific. The sulfur content of the catalytically cracked fractions will depend upon the sulfur content of the feed to the cracker as well as the boiling range of the selected fraction used as feed to the processes disclosed herein.

In general, lighter fractions will have lower sulfur content than higher boiling fractions. The light front end of the naphtha contains most of the high octane olefins but relatively little of the sulfur. The sulfur components in the light front end are mainly mercaptans, and typical of those compounds are methyl mercaptan, ethyl mereaptan, n-propyl mercaptan, isopropyl mercaptan, iso-butyl mercaptan, tert-butyl mercaptan, n-butyl mercaptan, sec-butyl mercaptan, iso-amyl mercaptan, n-amyl mercaptan, alpha-methyl butyl mercaptan, 2-mercapto hexane, and 3-mercapto hexane. Thiophene may also be present, having a boiling point of about 180° F.

Heavier fractions contain a larger amount of sulfur compounds, and a larger fraction of these sulfur compounds are in the form of aromatic heterocyclic compounds.

In addition, certain streams commonly blended for gasoline, such as FCC feedstocks, contain high amounts of the heterocyclic compounds. Gasoline streams containing significant amounts of these heterocyclic compounds are often difficult to process using many of the prior art methods described above. Very severe operating conditions have been conventionally specified for hydrotreating processes to desulfurize gasoline streams, resulting in a large octane penalty. Adsorption processes, used as an alternative to hydrogen processing, have very low removal efficiencies, since the aromatic heterocyclic sulfur compounds have adsorptive properties similar to the aromatic compounds in the hydrocarbon matrix.

Aromatic heterocyclic compounds that may be removed by the processes disclosed herein include alkyl substituted thiophene, thiophenol, alkylthiophene and benzothiophene. Among the aromatic heterocyclic compounds of particular interest are thiophene, 2-methylthiophene, 3-methylthiophene, 2-ethylthiophene, benzothiophene and dimethylbenzothiophene. These aromatic heterocyclic compounds are collectively termed "thiophenes." Mercaptans that may be removed by the processes described herein often contain from 2-10 carbon atoms, and are illustrated by materials such as 1-ethanthiol, 2-propanethiol, 2-butanethiol, 2-methyl-2-propanethiol, pentanethiol, hexanethiol, heptanethiol, octanethiol, nonanethiol and thiophenol.

Sulfur in gasoline originating from these gasoline streams may be in one of several molecular forms, including thiophenes, mercaptans and disulfides. For a given gasoline stream the sulfur compounds tend to be concentrated in the higher boiling portions of the stream, as described above. Such a stream may be fractionated, and the heavier fraction treated using the processes described herein. Alternatively, the entire stream may be treated using the processes described herein. For example, light gasoline streams that are particularly rich in sulfur compounds, such as coker pentane/hexane, may be suitably treated as a blend stream which also contains a higher boiling, lower sulfur containing component.

In general, gasoline streams suited for treatment using the processes disclosed herein contain greater than about 10 ppm thiophenic compounds. Typically, streams containing more than 40 ppm thiophenic compounds, up to 2000 ppm thiophenic compounds and higher may be treated using the processes as described herein. The total sulfur content of the gasoline stream to be treated using the processes disclosed herein will generally exceed 50 ppm by weight, and typically range from about 150 ppm to as much as several thousand ppm sulfur. For fractions containing at least 5 volume percent boiling over about 380° F. (over about 193° C.), the sulfur content may exceed about 1000 ppm by weight, and may be as high as 4000 to 7000 ppm by weight or even higher.

In addition to the sulfur compounds, naphtha feeds, including FCC naphtha, may include paraffins, naphthenes, and aromatics, as well as open-chain and cyclic olefins, dienes, and cyclic hydrocarbons with olefinic side chains. A cracked naphtha feed useful in the processes described herein may have an overall olefins concentration ranging from about 5 to 60 weight percent in some embodiments; from about 25 to 50 weight percent in other embodiments.

Embodiments disclosed herein relate to a process for reducing the sulfur content of a hydrocarbon stream. The hydrocarbon stream may include, for example, a naphtha fraction, such as a pre-fractionated full range naphtha, where a light naphtha cut is separated, and the intermediate and heavy naphtha may be treated according to processes disclosed herein, to result in a gasoline fraction having a low endpoint.

In general, the process may include feeding a naphtha fraction containing organic sulfur compounds to a first catalytic distillation reactor system having one or more reaction zones including a hydrodesulfurization catalyst. Hydrogen may also be fed to the first catalytic distillation reactor system, and in some embodiments, a portion of the hydrogen may be fed below each reaction zone.

In the first catalytic distillation reactor system, the naphtha fraction may be fractionated into a heavy naphtha fraction and an intermediate naphtha fraction. Hydrogen and the intermediate naphtha fraction may be contacted in at least one of the reaction zones to form hydrogen sulfide and an intermediate naphtha fraction of reduced organic sulfur content. Additionally, hydrogen and the heavy naphtha fraction may also be contacted in a reaction zone to form hydrogen sulfide and a heavy naphtha fraction of reduced organic sulfur content. The intermediate naphtha fraction, hydrogen sulfide, and any unreacted hydrogen may be recovered as a first overheads fraction, and the heavy naphtha fraction and any dissolved hydrogen sulfide may be recovered as a first bottoms fraction.

At least a portion of the hydrogen sulfide may be stripped from the first overheads fraction, and the stripped overheads may be fed to a second catalytic distillation reactor system. The amount of hydrogen sulfide stripped from the first overheads fraction may affect the performance of the second catalytic distillation reactor system (sulfur reduction, reaction kinetics, etc.). In some embodiments, the stripped first overheads fraction may contain less than 400 ppm hydrogen sulfide; less than 300 ppm hydrogen sulfide in other embodiments; less than 250 ppm in other embodiments; less than 200 ppm in other embodiments; less than 175 ppm in other embodiments; less than 150 ppm in other embodiments; less than 125 ppm in other embodiments; and less than 100 ppm in yet other embodiments.

The stripped first overheads fraction, as mentioned above, may be fed to a second catalytic distillation reactor system having one or more reaction zones including a hydrodesulfurization catalyst. Hydrogen may also be fed to the second catalytic distillation reactor system, and in some embodiments, a portion of the hydrogen may be fed below each reaction zone.

In the second catalytic distillation reactor system, the stripped first overheads fraction stream may be fractionated into a light intermediate naphtha fraction and a heavy intermediate naphtha fraction. Hydrogen and the light intermediate naphtha fraction may be contacted in at least one of the reaction zones to form hydrogen sulfide and a light intermediate naphtha fraction of reduced organic sulfur content. Additionally, hydrogen and the heavy intermediate naphtha fraction may be contacted in at least one of the reaction zones to form hydrogen sulfide and a heavy intermediate naphtha fraction of reduced organic sulfur content. The light intermediate naphtha fraction, hydrogen sulfide, and any unreacted hydrogen may be recovered as a second overheads fraction, and the heavy intermediate naphtha fraction may be recovered as a second bottoms fraction.

At least a portion of the second bottoms fraction may be recycled to the first catalytic distillation reactor system. In some embodiments, the entirety of the second bottoms fraction may be recycled to the first catalytic distillation reactor system. The recycled heavy intermediate fraction participates in the reaction and fractionation described above for the first catalytic distillation reactor system, and at steady state, a portion may be cyclically processed with the first overhead fraction, and a portion may be recovered with the first bottoms fraction.

The dissolved hydrogen sulfide may be stripped from the first bottoms fraction, to recover a heavy naphtha stream of reduced sulfur content. The heavy naphtha may be further processed, used as a gasoline blendstock, or may be used as a heavy gasoline fraction for diesel or jet fuel. The hydrogen sulfide may also be stripped from the second overheads fraction, to recover a light intermediate naphtha fraction of reduced sulfur content.

A portion of the overhead fractions recovered from each of the first and second catalytic distillation reactor systems may be used as reflux for control of vapor and liquid traffic in the distillation column reactor systems. For example, the overheads fractions may pass through one or more condensation stages, such as a hot drum, a cold drum, or both. A portion of the condensed material may be fed to the respective column as reflux and the remaining condensed portion and the non-condensed materials may be fed to a stripper to remove hydrogen sulfide and unreacted hydrogen. In some embodiments, hydrogen and hydrogen sulfide may also be recovered from a cold drum, thereby reducing the pressure drop of the hydrogen and correspondingly decreasing compressor duty required for hydrogen recycle.

In some embodiments, a portion of the stripped overheads may be used as reflux. In these embodiments, the stripped reflux may result in a reduction of hydrogen sulfide circulating in the overhead system, and may further reduce recombinant mercaptan formation over that achieved with a traditional reflux from a hot or cold drum as described above. However, cost, logistics, and other operational requirements may negatively impact the desire for this option.

The processes described herein, using catalytic distillation reactor systems, may allow flexibility in the end point of the recovered light intermediate fraction. In some embodiments, the end point of the light intermediate naphtha fraction recovered may be 330° F. or less; 320° F. or less in other embodiments; 310° F. or less in other embodiments; 300° F. or less in other embodiments; 290° F. or less in other embodiments; 280° F. or less in other embodiments; and 270° F. or less in yet other embodiments. As economic and seasonal conditions change, it may be advantageous to send a portion of the heavy gasoline into the diesel or jet fuel pools, for example. The processes disclosed herein allow a producer the desired flexibility in gasoline end point to adapt to the changes in economic and seasonal conditions.

Processes disclosed herein may also result in reduced recombinant mercaptan formation. Because the sulfur concentration is highest in the heavy end of the naphtha, a large portion of the desulfurization is accomplished in the first column, where the heavy gasoline is primarily treated. Overall, it is expected that greater than 70 to 80 percent of the sulfur removal will occur in the first column. Because hydrogen sulfide is removed from the first overhead fraction between the columns (as opposed to directly feeding the overheads to the second column), the concentration of hydrogen sulfide in the second column will be about 70 to 80 percent lower than if the gasoline were treated in a single column. Thus, the driving force (i.e., hydrogen sulfide concentration) to produce mercaptans in the second column will be reduced. When this is combined with the natural tendency of mercaptans to distill downward in the second column, the mercaptan concentration surviving in the final overhead product from the second column is low. This enables production of very low sulfur content gasolines without the need to saturate olefins. In some embodiments, no further treatment of the gasoline to remove mercaptans would be required.

With regard to the second catalytic distillation reactor system operations, it is important to have some heavier material in the bottom of the column, such as to provide liquid and vapor traffic control through the reboiler. The amount of heavier material fed to the second column may be affected by the operating conditions in the first column, where a higher overhead temperature or lower operating pressure may allow heavier components overhead. In some embodiments, a portion of the second catalytic distillation reactor system bottoms may be recycled to the second distillation column feed. In other embodiments, a portion of the first distillation reactor system bottoms may be fed to the second distillation column. The feed of these heavier components may enhance operations in the second catalytic distillation reactor system without affecting end point control, due to the recycle of these heavier components to the first column. The heavier material may also help mitigate fouling in the reboiler of the second column as the heavier materials are low in olefins.

Additionally, the recycle to the first column may contain some of the mercaptans which form in the second column, as well as some heavy sulfides and other byproducts which distill downward in the second column. These compounds can be effectively treated in the first column.

In some embodiments, the bottoms of the second column are lower boiling than the bottoms of the first column. This may allow the second column to run at higher operating pressures than the first column, and would uncouple the treating conditions of the two catalytic distillation stages. The increased pressure range thus attainable may allow the operator a greater flexibility to increase or decrease the end point of the gasoline recovered via the second column overheads.

After treatment according to the processes described herein, the sulfur content of the treated stream may be less than about 50 ppm in some embodiments; less than 40 ppm in other embodiments; less than 30 ppm in other embodiments; less than 20 ppm in other embodiments; less than 10 ppm in other embodiments; less than 5 ppm in other embodiments; and less than 1 ppm in yet other embodiments, where each of the above are based on weight. The gasoline may have a total sulfur content of less than 20 mg/l in other embodiments; less than 10 mg/l in other embodiments; and less than 5 mg/l in yet other embodiments.

In contrast to typical hydrodesulfurization processes, which typically use harsh operating conditions resulting in significant loss of olefins, desulfurized products resulting from the processes disclosed herein may retain a significant portion of the olefins, resulting in a higher value end product. In some embodiments, products resulting from the processes described herein may have an overall olefins concentration ranging from 5 to 55 weight percent; from about 10 to about 50 weight percent in other embodiments; and from about 20 to about 45 weight percent in other embodiments.

As described above, processes described herein may treat a naphtha or gasoline fraction in one or more catalytic distillation reactor systems. The catalytic distillation reactor systems may have one or more reactive distillation zones containing hydrodesulfurization catalyst. For example, reactive distillation zones may be contained within the stripping section, hydrodesulfurizing the heavier compounds, within the rectification section, hydrodesulfurizing the lighter compounds, or both.

The catalytic distillation steps may be carried out at a temperature in the range of 130° F. to 800° F. at 0 to 400 psig pressure, with hydrogen partial pressures in the range of 0.1 to 100 psi. Hydrogen feed may be 20 to 1200 scf/bbl, and the column may be operated at weight hourly space velocities (WHSV) in the range of 0.1 to 10 $hr^{-1}$ based on feed rate and particulate catalyst packaged in structures. If advanced specialty catalytic structures are used (where catalyst is one with the structure rather than a form of packaged pellets to be held in place by structure), the LHSV for such systems should be about in the same range as those of granular-based catalytic distillation catalyst systems as just referenced. As can be seen, the conditions suitable for the desulfurization of naphtha in a distillation column reactor system are very different from those in a standard trickle bed reactor, especially with regard to total pressure and hydrogen partial pressure. In other embodiments, conditions in a reaction distillation zone of a naphtha hydrodesulfurization distillation column reactor system are: temperatures in the range from 150° F. to 700° F., total pressure in the range from 75 to 350 psig, hydrogen partial pressure in the range from 6 to 150 psia, WHSV of naphtha in the range from about 1 to 5, and hydrogen feed rates in the range from 10-1000 scf/bbl.

The operation of the distillation column reactor results in both a liquid and vapor phase within the distillation reaction zone. A considerable portion of the vapor is hydrogen while a portion is vaporous hydrocarbon from the petroleum fraction. In the catalytic distillation it has been proposed that the mechanism that produces the effectiveness of the present process is the condensation of a portion of the vapors in the reaction system, which occludes sufficient hydrogen in the condensed liquid to obtain the requisite intimate contact between the hydrogen and the sulfur compounds in the presence of the catalyst to result in their hydrogenation. In particular, sulfur species concentrate in the liquid while the olefins and $H_2S$ concentrate in the vapor allowing for high conversion of the sulfur compounds with low conversion of the olefin species. The result of the operation of the process in the distillation column reactor is that lower hydrogen partial pressures (and thus lower total pressures) may be used.

As in any distillation, there is a temperature gradient within the distillation column reactor system. The lower end of the column contains higher boiling material and thus is at a higher temperature than the upper end of the column. The lower boiling fraction, which contains more easily removable sulfur compounds, is subjected to lower temperatures at the top of the column which provides for greater selectivity, that is, less saturation of desirable olefinic compounds. The higher boiling portion is subjected to higher temperatures in the lower end of the distillation column reactor to crack open the sulfur containing ring compounds and hydrogenate the sulfur. The heat of reaction simply creates more boil up, but no increase in temperature at a given pressure. As a result, a great deal of control over the rate of reaction and distribution of products can be achieved by regulating the system pressure.

Catalysts useful as the hydrodesulfurization catalyst in the reactive distillation zone of the catalytic distillation reactor system may include Group VIII metals such as cobalt, nickel, palladium, alone or in combination with other metals such as molybdenum or tungsten on a suitable support which may be alumina, silica-alumina, titania-zirconia or the like. Normally the metals are provided as the oxides of the metals supported on extrudates or spheres and as such are not generally useful as distillation structures. Alternatively, catalyst may be packaged in a suitable catalytic distillation structure which characteristically can accommodate a wide range of typically manufactured fixed-bed catalyst sizes.

The catalysts may contain components from Group V, VIB, VIII metals of the Periodic Table or mixtures thereof. The use of the distillation column reactor system may reduce the deactivation of catalyst and may provide for longer runs than the fixed bed hydrogenation units of the prior art. The Group VIII metal may also provide increased overall average activity. Catalysts containing a Group VIB metal, such as molybdenum, and a Group VIII metal, such as cobalt or nickel, are preferred. Catalysts suitable for the hydrodesulfurization reaction include cobalt-molybdenum, nickel-molybdenum and nickel-tungsten. The metals are generally present as oxides supported on a neutral base such as alumina, silica-alumina or the like. The metals are converted to the sulfide either in use or prior to use by exposure to sulfur compound containing streams and hydrogen.

The catalyst may also catalyze the hydrogenation of the olefins and polyolefins contained within the light cracked naphtha and to a lesser degree the isomerization of some of the mono-olefins. The hydrogenation, especially of the mono-olefins in the lighter fraction, may not be desirable.

The catalyst typically is in the form of extrudates having a diameter of ⅛, 1/16 or 1/32 inches and an L/D of 1.5 to 10. The catalyst also may be in the form of spheres having similar diameters. They may be directly loaded into standard single pass fixed bed reactors which include supports and reactant distribution structures. However, in their regular form they form too compact a mass for operation in the catalytic distillation hydrodesulfurization tower and must then be prepared in the form of a catalytic distillation structure. The catalytic distillation structure must be able to function as catalyst and as mass transfer medium. The catalyst must be suitably supported and spaced within the column to act as a catalytic distillation structure.

In some embodiments, the catalyst is contained in a structure as disclosed in U.S. Pat. No. 5,730,843, which is hereby incorporated by reference. In other embodiments, catalyst is contained in a plurality of wire mesh tubes closed at either end and laid across a sheet of wire mesh fabric such as demister wire. The sheet and tubes are then rolled into a bale for loading into the distillation column reactor. This embodiment is described, for example, in U.S. Pat. No. 5,431,890, which is hereby incorporated by reference. Other useful catalytic distillation structures are disclosed in U.S. Pat. Nos. 4,731,229, 5,073,236, 5,431,890 and 5,266,546, which are each incorporated by reference.

Referring now to FIG. 1, a simplified flow diagram for hydrodesulfurization processes having flexibility in varying the end point of a gasoline product, according to embodiments disclosed herein, is illustrated. The process may include feeding a naphtha fraction, such as a pre-fractionated naphtha, containing organic sulfur compounds via flow line 8 to a first catalytic distillation reactor system 10 having one or more reaction zones 12, 14 including a hydrodesulfurization catalyst. Hydrogen may also be fed via flow lines 16, 18 to a point below each reaction zone 12, 14. The intermediate range naphtha is boiled up into the reactive rectification section 12 and removed along with unreacted hydrogen and hydrogen sulfide as an overheads fraction via flow line 19. The heavy naphtha travels down the column into reactive distillation section 14, and may be recovered via flow line 20. Unreacted hydrogen and hydrogen sulfide produced from the hydrodesulfurization of the heavy naphtha in reactive distillation zone 14 boils up through reactive distillation zone 12 and is collected with the overheads fraction via flow line 19. The catalytic distillation reactor system 10 may have a reboiler 22, for maintaining temperature control and vapor/liquid traffic within column 10.

The first overheads fraction recovered via flow line 19 may be cooled and at least partially condensed via one or more heat exchangers 24, and separated into vapor and liquid phases in one or more vessels 26. As noted, more than one heat exchanger/accumulator may be used, such as a hot drum and a cold drum, referred to as such based upon the respective operating temperatures. Materials condensed may be recovered via flow line 28, a portion of which may be fed as reflux via flow line 30 to catalytic distillation reactor system 10. Any portion not used as reflux and non-condensed materials may be fed to stripper 32 via flow lines 34, 36, respectively.

Stripper 32 may further reduce the amount of hydrogen sulfide in the overheads fraction, and the stripped first overheads fraction may be fed to a second distillation reactor system 38 via flow line 40. Hydrogen and hydrogen sulfide recovered from stripper 32 via flow line 42 may be treated to remove at least a portion of the hydrogen sulfide, and the hydrogen may be recycled, if desired. Optionally, hydrogen and hydrogen sulfide may be recovered via flow line 44, reducing the pressure drop of the recovered hydrogen, reducing hydrogen recycle compressor duty. Stripper 32 may allow recovery of hydrogen and hydrogen sulfide vapors and may also remove at least a portion of dissolved hydrogen sulfide from the first overheads fraction.

The stripped first overheads fraction, which may be an intermediate naphtha, may be fed to a second catalytic distillation reactor system 38 having one or more reaction zones 46, 48 including a hydrodesulfurization catalyst. Hydrogen may also be fed to the second catalytic distillation reactor system 38 via flow lines 50, 52, where a portion of the hydrogen may be fed below each reaction zone.

The light intermediate range naphtha is boiled up into the reactive rectification section 46 and removed along with unreacted hydrogen and hydrogen sulfide as an overheads fraction via flow line 56. The heavy intermediate naphtha travels down the column into reactive distillation section 48, and may be recovered via flow line 60.

Unreacted hydrogen and hydrogen sulfide produced from the hydrodesulfurization of the heavy naphtha in reactive distillation zone 48 boils up through reactive distillation zone 46 and is collected with the overheads fraction via flow line 56. The catalytic distillation reactor system 38 may have a reboiler 58, for maintaining temperature control and vapor/liquid traffic within column 38.

A bottoms fraction from the second catalytic distillation reactor system 38 may be recovered via flow line 60. At least a portion of the second bottoms fraction may be recycled via flow line 62 to the first catalytic distillation reactor system 10. In some embodiments, at least a portion of the second bottoms fraction recovered via flow line 60 may be recycled to the second catalytic distillation reactor system 38 via flow line 64, such as to maintain some heavier material circulating in the bottom of second catalytic distillation reactor system 38 and reboiler 58.

The second overheads fraction recovered via flow line 56 may be cooled and at least partially condensed via one or more heat exchangers 66, and the liquid and vapor phases may be separated and recovered in one or more vessels 68, such as a hot drum and a cold drum. Materials condensed may be recovered via flow line 70, a portion of which may be fed as reflux via flow line 72 to catalytic distillation reactor system 38. Any portion not used as reflux and non-condensed materials may be fed to stripper 74 via flow lines 76, 78, respectively.

Stripper 32 may further reduce the amount of hydrogen sulfide in the second overheads fraction, producing a low end point gasoline which may be recovered via flow line 80. Hydrogen and hydrogen sulfide recovered from stripper 74 via flow line 82 may be treated to remove at least a portion of the hydrogen sulfide, and the hydrogen may be recycled, if desired. Optionally, hydrogen and hydrogen sulfide may be recovered via flow line 84, reducing the pressure drop of the recovered hydrogen, reducing hydrogen recycle compressor duty. As another alternative, providing additional flexibility to the control of the end point of the naphtha fraction recovered via line 80, a portion of the second bottoms fraction recovered via flow line 60 may be combined with the overheads fraction in line 76 or fed directly to stripper 74.

The first column bottoms fraction recovered via flow line 20 may be fed to a stripper 86 to strip any dissolved hydrogen sulfide that may be in the first bottoms fraction. The stripped hydrogen sulfide may be recovered via flow line 88, and a heavy naphtha stream of reduced sulfur content may be recovered via flow line 90. The heavy naphtha recovered via flow line 90 may be further processed, used as a gasoline blendstock, or may be used as a heavy gasoline fraction for diesel or jet fuel.

The pre-fractionated naphtha feed used in embodiments disclosed herein may be derived from a variety of sources. For example, the pre-fractionated naphtha feed may be a bottoms product recovered from a splitter, a catalytic distillation reactor system for hydrodesulfurizing a light naphtha cut, or from a distillation column following a fixed bed hydrodesulfurization reactor or a selective hydrogenation unit. These embodiments are illustrated in FIGS. 2-4, where like numerals represent like parts.

Figure 2:
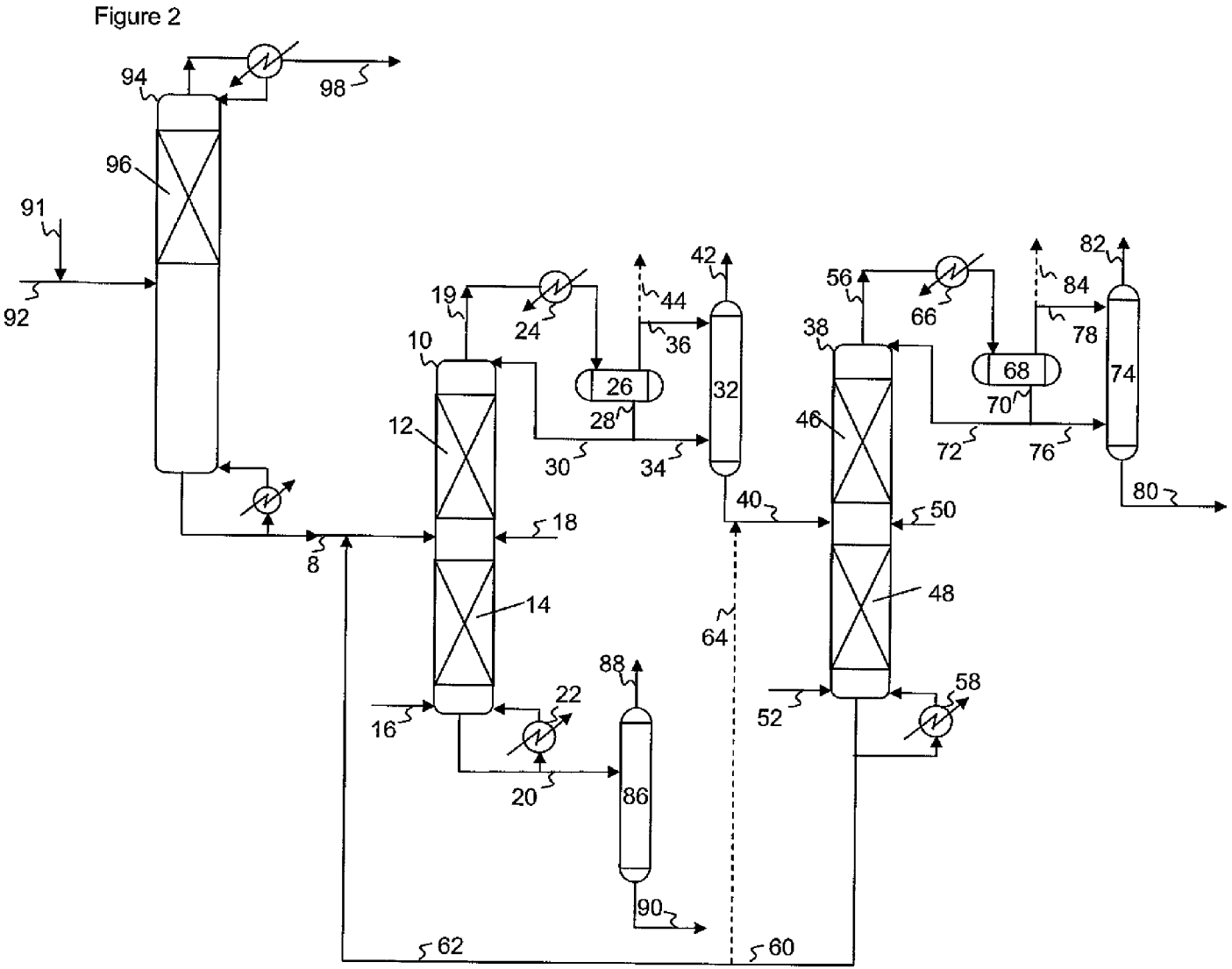
FIG. 2 is a simplified flow diagram for hydrodesulfurization processes having flexibility in varying the end point of a gasoline product with front end treatment and separation according to embodiments disclosed herein.

Referring now to FIG. 2, a simplified flow diagram for hydrodesulfurization processes having flexibility in varying the end point of a gasoline product, with front end treatment and separation according to embodiments disclosed herein, is illustrated. Hydrogen, via flow line 91, and a full range naphtha, via flow line 92, may be fed to a catalytic distillation reactor system 94 having at least one reaction zone 96 including a catalyst, such as a catalyst containing a Group VIII metal, useful for reacting mercaptans and at least a portion of highly unsaturated compounds in the full range naphtha, such as dienes, to form heavier sulfide compounds. A light naphtha cut, such as a $C_4$ to a $C_6$ cut having a reduced mercaptan content and a reduced content of highly unsaturated compounds, may be recovered via flow line 98. Acetylenes and dienes may also react with one or more of hydrogen and hydrogen sulfide, if present, over the Group VIII metal catalyst to form olefins, saturated hydrocarbons, and sulfides. The bottoms fraction, including the heavier sulfide compounds, recovered from catalytic distillation reactor system 94 may be used as the pre-fractionated naphtha feed, fed via flow line 8 and processed as described with respect to FIG. 1.

Figure 3:
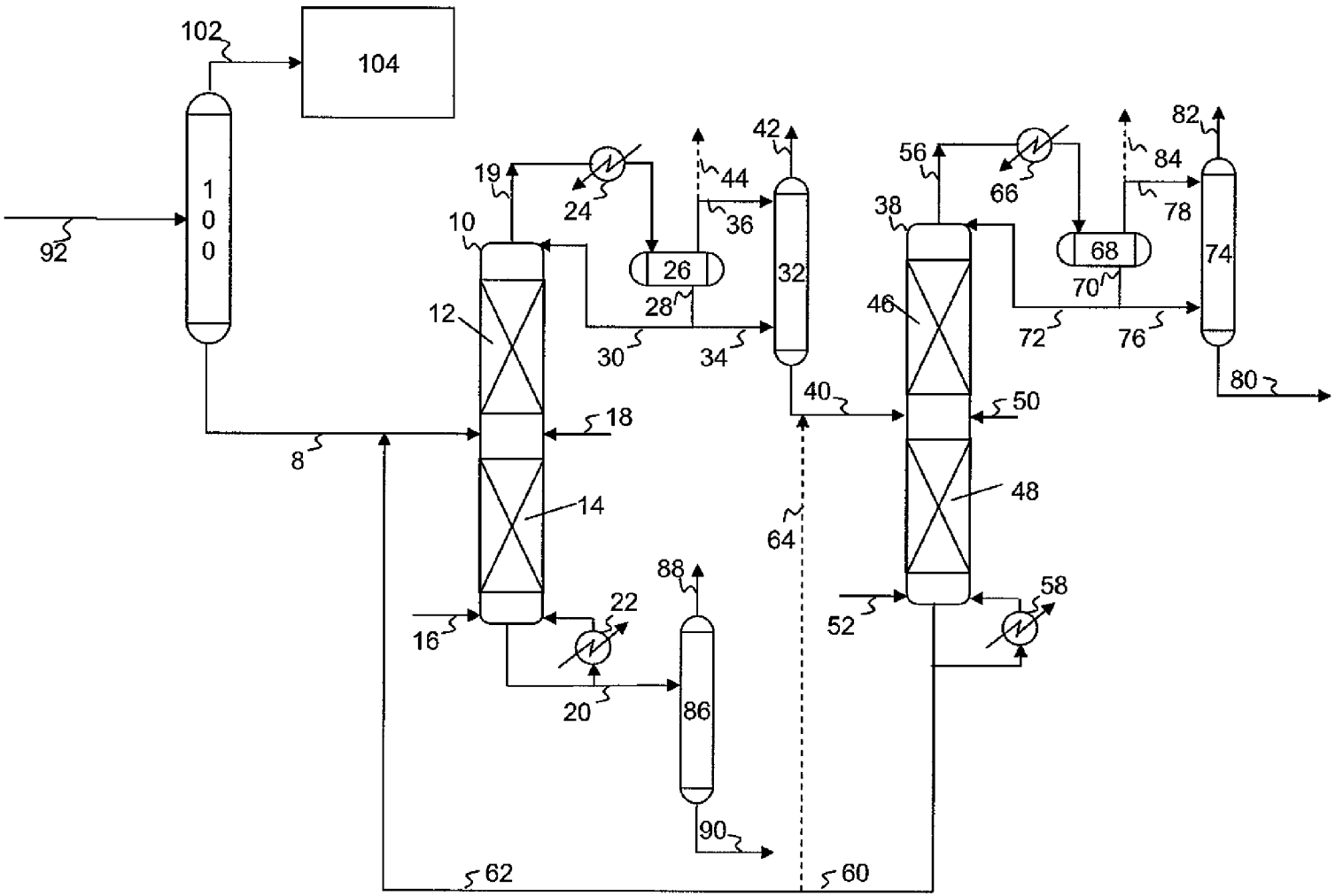
FIG. 3 is a simplified flow diagram for hydrodesulfurization processes having flexibility in varying the end point of a gasoline product with front end treatment and separation according to embodiments disclosed herein.

Referring now to FIG. 3, a simplified flow diagram for hydrodesulfurization processes having flexibility in varying the end point of a gasoline product, with front end treatment and separation according to embodiments disclosed herein, is illustrated. A full range naphtha may be fed via flow line 92 to a splitter 100. A light naphtha fraction, containing sulfur compounds which are mostly mercaptans may be recovered from splitter 100 via flow line 102. Optionally, the light naphtha fraction may be treated via a caustic wash process 104 to separate the mercaptans from the light naphtha. A heavier naphtha fraction may be recovered from the bottoms of splitter 100, which may then be fed via flow line 8 and processed as described with respect to FIG. 1.

Figure 4:
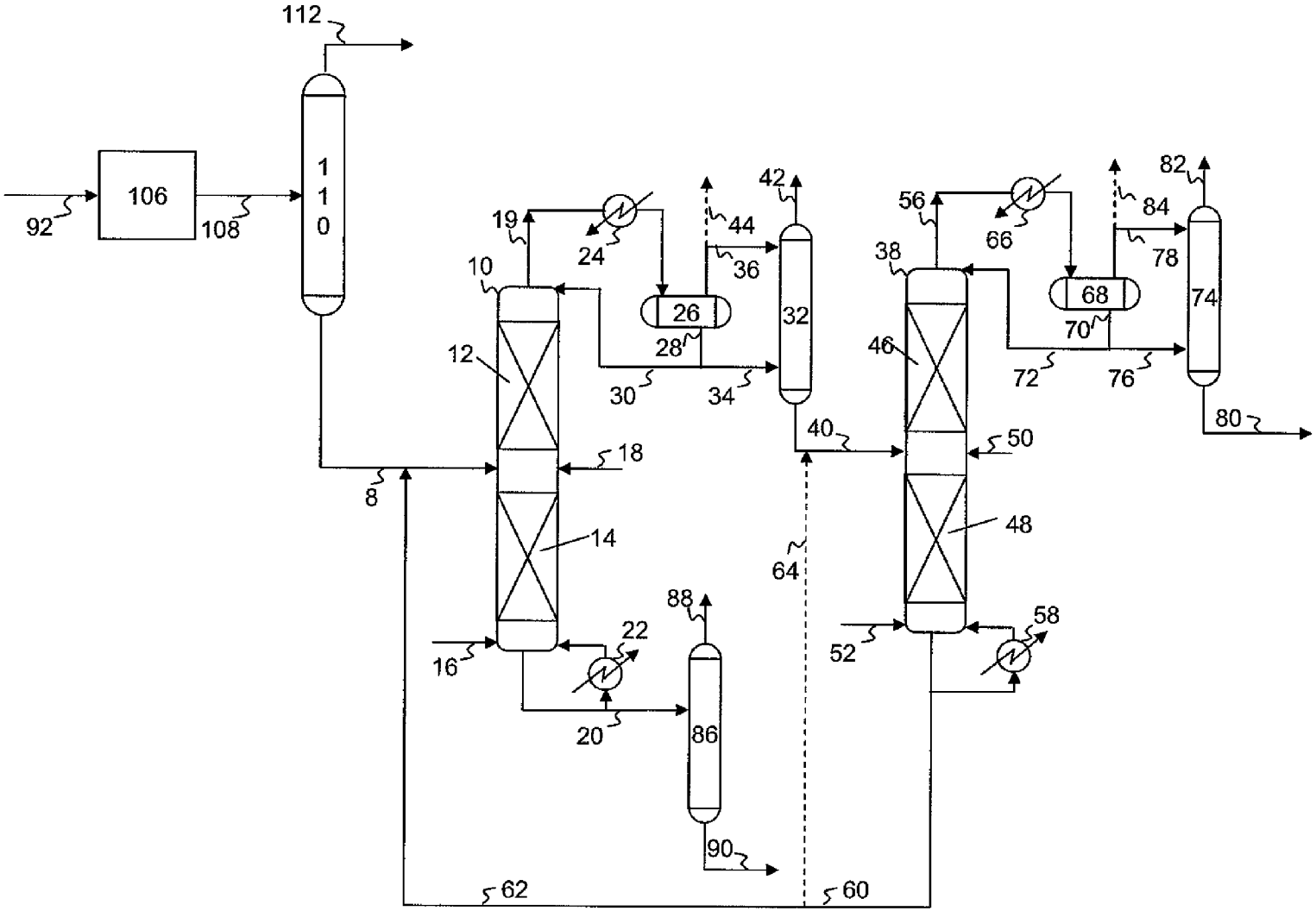
FIG. 4 is a simplified flow diagram for hydrodesulfurization processes having flexibility in varying the end point of a gasoline product with front end treatment and separation according to embodiments disclosed herein.

Referring now to FIG. 4, a simplified flow diagram for hydrodesulfurization processes having flexibility in varying the end point of a gasoline product, with front end treatment and separation according to embodiments disclosed herein, is illustrated. A full range naphtha fraction may be fed via flow line 92 to a selective hydrogenation unit 106, such as to convert dienes in the feed to olefinic compounds. Reactor effluent may be recovered via flow line 108 and fed to a distillation column 110 to separate a light naphtha fraction from a heavier naphtha fraction. The light naphtha fraction may be recovered from the top of distillation column 110 via flow line 112, and further processed as desired. The heavier naphtha fraction may be recovered from the bottoms of distillation column 110 and fed via flow line 8 and processed as described with respect to FIG. 1.

Other flow schemes to achieve the desired feed to the processes disclosed herein may also be used. Additionally, various other feedstocks may also be processed, where the light or light intermediate fraction recovered has a low end point and the process affords flexibility in the endpoint.

EXAMPLES

A pre-fractionated naphtha stream was treated in a process similar to that illustrated in FIG. 1. The pre-fractionated naphtha feed was processed at about 50 lb/h, and contained approximately 2900 ppm sulfur, by weight, had a Bromine Number of about 39.3, and a boiling range as given in Table 1. Hydrogen feed rates and naphtha feed temperature are also given in Table 1.

TABLE 1

| | |
|---|---|
| PF Naphtha feed rate (lb/h) | 49.9 |
| Feed Sulfur (wppm) | 2904.8 |
| Feed Bromine Number | 39.3 |
| Initial Boiling Point (ASTM 3710), ° F. | 155 |
| 5% boiling point | 171 |
| 10% boiling point | 185 |
| 20% boiling point | 208 |
| 30% boiling point | 231 |
| 40% boiling point | 276 |
| 50% boiling point | 292 |
| 60% boiling point | 336 |
| 70% boiling point | 363 |

TABLE 1-continued

| | |
|---|---|
| 80% boiling point | 396 |
| 90% boiling point | 425 |
| 95% boiling point | 444 |
| Final boiling point | 476 |
| Hydrogen Sulfide in Feed (ppm) | 34.4 |
| Feed Temperature, ° F. | 499.8 |
| Reboiler Hydrogen, scfh | 49.9 |
| Reboiler methane, scfh | 2 |
| Reboiler hydrogen purity, vol. % | 96.13 |
| Feed point hydrogen, scfh | 20.1 |
| Column Pressure, top tray (psig) | 230 |
| Upper Catalyst Bed Temperature, ° F. | 502 |
| Lower Catalyst Bed Temperature, ° F. | 582 |
| Hot Drum Temperature, ° F. | 393 |
| Reflux Ratio | 1.87 |

The pre-fractionated naphtha feed was fed to a first distillation column reactor loaded with 24.4 pounds of catalyst (DC-130, a cobalt-molybdenum catalyst available from Criterion). The feed was located such that approximately 28 percent of the catalyst, by weight, was above the feed location. The hydrodesulfurized overhead product was partially condensed using a hot drum, and a portion of the condensed material was used as reflux. The remaining fraction of the condensed portion and the non-condensed portion were then fed to a stripper to remove the hydrogen sulfide and to collect an intermediate naphtha overhead fraction of reduced sulfur content. A sample of the hydrodesulfurization distillation product streams was collected during the run and analyzed, the results of which are presented in Table 2.

TABLE 2

| Intermediate Naphtha Overheads | |
|---|---|
| Overhead Recovery | 60.11% |
| Overhead Sulfur (wppm) | 243.6 |
| Sulfur Conversion | 94.4 wt. % |
| Overhead Mercaptan (RSH), wppm | 95 (estimated) |
| Overhead Bromine Number | 41.1 |
| Bromine Number Conversion (%) | 35.3 |
| Initial Boiling Point (ASTM 3710), ° F. | 148 |
| 5% boiling point | 161 |
| 10% boiling point | 175 |
| 20% boiling point | 192 |
| 30% boiling point | 201 |
| 40% boiling point | 215 |
| 50% boiling point | 231 |
| 60% boiling point | 254 |
| 70% boiling point | 277 |
| 80% boiling point | 283 |
| 90% boiling point | 317 |
| 95% boiling point | 328 |
| Final boiling point | 350 |
| Heavy Naphtha Bottoms | |
| Bottoms Sulfur (wppm) | 42 |
| Bottoms Sulfur Conversion | 99.24 wt. % |
| Initial Boiling Point (ASTM 3710), ° F. | 313 |
| 5% boiling point | 325 |
| 10% boiling point | 336 |
| 20% boiling point | 348 |
| 30% boiling point | 364 |
| 40% boiling point | 375 |
| 50% boiling point | 394 |
| 60% boiling point | 404 |
| 70% boiling point | 413 |
| 80% boiling point | 430 |
| 90% boiling point | 446 |
| 95% boiling point | 454 |
| Final boiling point | 483 |
| Hydrogen Conversion (wt. %) | 31.2 |

The intermediate naphtha collected was then processed in a second distillation column reactor loaded with 24.4 lbs. of catalyst (DC-130, a cobalt-molybdenum catalyst available from Criterion) The feed was located such that approximately 28 percent of the catalyst, by weight, was above the feed location. The feed to the second distillation column, on average, is presented in Table 3.

TABLE 3

| | |
|---|---|
| Second Column feed rate (lb/h) | 35 |
| Feed Sulfur (wppm) | 324.8 |
| Feed Bromine Number | 38.9 |
| Hydrogen Sulfide in Feed (ppm) | 24.1 |
| Feed Temperature, ° F. | 459.8 |
| Reboiler Hydrogen, scfh | 24.7 |
| Reboiler methane, scfh | 2 |
| Reboiler hydrogen purity, vol. % | 92.53 |
| Feed point hydrogen, scfh | 15 |
| Column Pressure, top tray (psig) | 250 |
| Upper Catalyst Bed Temperature, ° F. | 501 |
| Lower Catalyst Bed Temperature, ° F. | 577 |
| Hot Drum Temperature, ° F. | 397 |
| Reflux Ratio | 1.88 |

The hydrodesulfurized overhead product from the second distillation column reactor was partially condensed using a hot drum, and a portion of the condensed material was used as reflux. The remaining fraction of the condensed portion and the non-condensed portion were then fed to a splitter to remove the hydrogen sulfide and to collect a light intermediate naphtha fraction of reduced sulfur content. A sample of the hydrodesulfurization distillation product streams was collected during the run and analyzed, the results of which are presented in Table 4.

TABLE 4

| Light Intermediate Naphtha Overheads | |
|---|---|
| Overhead Recovery | 86% |
| Overhead Sulfur (wppm) | 21.8 |
| Sulfur Conversion | 94.2 wt. % |
| Overhead Bromine Number | 33.7 |
| Bromine Number Conversion (%) | 25.4 |
| Initial Boiling Point (ASTM 3710), ° F. | 145 |
| 5% boiling point | 158 |
| 10% boiling point | 174 |
| 20% boiling point | 192 |
| 30% boiling point | 197 |
| 40% boiling point | 209 |
| 50% boiling point | 229 |
| 60% boiling point | 238 |
| 70% boiling point | 259 |
| 80% boiling point | 280 |
| 90% boiling point | 285 |
| 95% boiling point | 290 |
| Final boiling point | 328 |
| Heavy Intermediate Naphtha Bottoms | |
| Bottoms Sulfur (wppm) | 0.5 |
| Initial Boiling Point (ASTM 3710), ° F. | 286 |
| 5% boiling point | 310 |
| 10% boiling point | 319 |
| 20% boiling point | 325 |
| 30% boiling point | 327 |
| 40% boiling point | 332 |
| 50% boiling point | 336 |
| 60% boiling point | 340 |
| 70% boiling point | 341 |
| 80% boiling point | 349 |
| 90% boiling point | 362 |
| 95% boiling point | 371 |
| Final boiling point | 395 |
| Hydrogen Conversion (wt. %) | 22.1 |

The sulfur in the overhead product from the second column was essentially all mercaptan. As shown by the above results, the second column may have good selectivity, having a high sulfur conversion and a relatively low olefin conversion. This selectivity is similar as to that observed for processes having a fixed bed polishing reactor, such as in U.S. Pat. No. 6,303,020 ('020). However, unlike the '020 process, the processes described herein may allow the production of a low end point gasoline, and may allow flexibility in the end point of the gasoline produced.

Advantageously, embodiments disclosed herein may provide for reduced mercaptan content in a desulfurized naphtha stream. The reduced mercaptan content may be achieved without the need for stripping the gasoline of hydrogen sulfide prior to further treatment, which may reduce the complexity of the flow scheme and reduce the capital cost of the process. Additionally, embodiments disclosed herein advantageously provide for control or reduction of recombinant mercaptan formation.

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

What is claimed:

1. A process for reducing the sulfur content of a hydrocarbon stream, the process comprising:

feeding a pre-fractionated naphtha stream comprising organic sulfur compounds to a first catalytic distillation reactor system having one or more reaction zones comprising a hydrodesulfurization catalyst;

feeding hydrogen to the first catalytic distillation reactor system;

concurrently in the first catalytic distillation reactor system:

fractionating the pre-fractionated naphtha stream into a heavy naphtha fraction and an intermediate naphtha fraction;

contacting hydrogen and the intermediate naphtha fraction in at least one of the reaction zones to form hydrogen sulfide and an intermediate naphtha fraction of reduced organic sulfur content;

contacting hydrogen and the heavy naphtha fraction in at least one of the reaction zones to form hydrogen sulfide and a heavy naphtha fraction of reduced organic sulfur content;

recovering the intermediate naphtha fraction, hydrogen sulfide, and any unreacted hydrogen as a first overheads fraction;

recovering the heavy naphtha fraction and dissolved hydrogen sulfide as a first bottoms fraction;

stripping the hydrogen sulfide from the first overheads fraction;

feeding the stripped first overheads fraction to a second catalytic distillation reactor system having one or more reaction zones comprising a hydrodesulfurization catalyst;

feeding hydrogen to the second catalytic distillation reactor system;

concurrently in the second catalytic distillation reactor system:

fractionating the stripped first overheads fraction stream into a light intermediate naphtha fraction and a heavy intermediate naphtha fraction;

contacting hydrogen and the light intermediate naphtha fraction in at least one of the reaction zones to form hydrogen sulfide and a light intermediate naphtha fraction of reduced organic sulfur content;

contacting hydrogen and the heavy intermediate naphtha fraction in at least one of the reaction zones to form hydrogen sulfide and a heavy intermediate naphtha fraction of reduced organic sulfur content;

recovering the light intermediate naphtha fraction, hydrogen sulfide, and any unreacted hydrogen as a second overheads fraction;

recovering the heavy intermediate naphtha fraction as a second bottoms fraction;

recycling at least a portion of the second bottoms fraction to the first catalytic distillation reactor system;

stripping the hydrogen sulfide from the first bottoms fraction to recover a heavy naphtha fraction of reduced sulfur content;

stripping the hydrogen sulfide from the second overheads fraction to recover a light intermediate naphtha fraction of reduced sulfur content.

2. The process of claim 1, further comprising recycling at least a portion of the second bottoms fraction to the second catalytic distillation reactor system.

3. The process of claim 1, further comprising:

partially condensing the first overheads fraction; and recycling at least a portion of the partially condensed first overheads fraction to the first distillation column reactor system as reflux.

4. The process of claim 3, wherein the partially condensing the first overheads fraction comprises cooling the first overheads fraction and separating the resulting vapor and liquid in at least one of a hot drum and a cold drum.

5. The process of claim 1, further comprising:

partially condensing the second overheads fraction; and recycling at least a portion of the partially condensed second overheads fraction to the second distillation column reactor system as reflux.

6. The process of claim 5, wherein the partially condensing the second overheads fraction comprises cooling the second overheads fraction and separating the resulting vapor and liquid in at least one of a hot drum and a cold drum.

7. The process of claim 1, further comprising:

feeding a full range naphtha stream comprising organic sulfur compounds, including mercaptans, and highly unsaturated compounds, including dienes, to a third catalytic distillation reactor system having one or more reaction zones comprising a catalyst comprising a Group VIII metal;

feeding hydrogen to the third catalytic distillation reactor system;

concurrently in the third catalytic distillation reactor system:

fractionating the full range naphtha stream into a light naphtha fraction and an intermediate-heavy naphtha fraction;

contacting mercaptans and the dienes in at least one of the reaction zones to form sulfides and a light naphtha fraction of reduced mercaptan content;

recovering the light naphtha fraction having a reduced mercaptan content and any unreacted hydrogen as a third overheads fraction;

recovering an intermediate-heavy naphtha fraction including the sulfides as a third bottoms fraction; and feeding at least a portion of the third bottoms to the first catalytic distillation reactor system as the pre-fractionated naphtha feed.

8. The process of claim 1, further comprising:

fractionating a full range naphtha stream into a light naphtha fraction and an intermediate-heavy naphtha fraction;

feeding at least a portion of the intermediate-heavy naphtha fraction to the first catalytic distillation reactor system as the pre-fractionated naphtha feed.

9. The process of claim 8, further comprising removing at least a portion of the mercaptans in the light naphtha fraction using a caustic wash process.

10. The process of claim 8, further comprising:

feeding hydrogen and the full range naphtha to a fixed bed hydrodesulfurization reactor having one or more reaction zones comprising a hydrodesulfurization catalyst to produce an effluent comprising hydrogen sulfide and a full range naphtha of reduced sulfur content;

fractionating the effluent into a light naphtha fraction and an intermediate-heavy naphtha fraction;

feeding at least a portion of the intermediate-heavy naphtha fraction to the first catalytic distillation reactor system as the pre-fractionated naphtha feed.

11. The process of claim 1, wherein the light intermediate naphtha fraction has an end point of about 320° F. or less.

12. The process of claim 1, wherein the light intermediate naphtha fraction has an end point of about 280° F. or less.

13. The process of claim 1, wherein the pre-fractionated naphtha has a boiling range from about C6 to about 480° F. or greater.

14. The process of claim 1, wherein the pre-fractionated naphtha has a boiling range from about 140° F. to about 480° F. or greater.

15. The process of claim 1, wherein the stripped first overheads fraction fed to the second catalytic distillation reactor system contains less than 200 ppm hydrogen sulfide.

16. The process of claim 1, wherein the light intermediate naphtha fraction of reduced sulfur content contains less than 10 ppm sulfur.

* * * * *